US006064187A

United States Patent [19]

Redl et al.

[11] Patent Number: 6,064,187

[45] Date of Patent: May 16, 2000

[54] VOLTAGE REGULATOR COMPENSATION CIRCUIT AND METHOD

[75] Inventors: Richard Redl, Farvagny-le-Petit, Switzerland; Brian P. Erisman, Sunnyvale, Calif.; Jonathan M. Audy, San Jose, Calif.; Gabor Reizik, Pleasanton, Calif.

[73] Assignee: Analog Devices, Inc., Norwood, Mass.

[21] Appl. No.: 09/249,266

[22] Filed: Feb. 12, 1999

[51] Int. Cl.[7] ..... G05F 1/40

[52] U.S. Cl. ..... 323/285; 323/224

[58] Field of Search ..... 323/285, 224

[56] References Cited

U.S. PATENT DOCUMENTS 5,774,734 6/1998 Kikinis et al. ..... 323/282
5,912,552 6/1999 Tateishi ..... 323/285

OTHER PUBLICATIONS

Dimitry Goder & William R. Pelletier, "$V^2$ Architecture Provides Ultra–Fast Transient Response in Switch Mode Power Supplies", *HFPC Power Conversion*, Sep. 1996, pp. 19–23.

*Primary Examiner*—Shawn Riley
*Attorney, Agent, or Firm*—Koppel & Jacobs

[57] ABSTRACT

A method and circuit enable a voltage regulator to employ the smallest possible output capacitor that allows the regulator's output voltage to be maintained within specified boundaries for large bidirectional step changes in load current. This is achieved by employing an output capacitor which has a combination of the largest possible equivalent series resistance (ESR) and lowest possible capacitance that ensures that the peak voltage deviation for a step change in load current is no greater than the maximum allowed, and by compensating the regulator to ensure a response that is flat after the occurrence of the peak deviation. The invention is applicable to both switching and linear voltage regulators.

21 Claims, 9 Drawing Sheets

VOLTAGE REGULATOR COMPENSATION CIRCUIT AND METHOD

BACKGROUND OF THE INVENTION

1. Field of the Invention

This invention relates to the field of voltage regulators, and particularly to methods of improving a voltage regulator's response to a load transient.

2. Description of the Related Art

The purpose of a voltage regulator is to provide a nearly constant output voltage to a load, despite being powered by an unregulated input voltage and having to meet the demands of a varying load current.

In some applications, a regulator is required to maintain a nearly constant output voltage for a step change in load current; i.e., a sudden large increase or decrease in the load current demanded by the load. For example, a microprocessor may have a "power-saving mode" in which unused circuit sections are turned off to reduce current consumption to near zero; when needed, these sections are turned on, requiring the load current to increase to a high value—typically within a few hundred nanoseconds.

When there is a change in load current, some deviation in the regulator's output voltage is practically unavoidable. The magnitude of the deviation is affected by both the capacitance and the equivalent series resistance (ESR) of the output capacitor: a smaller capacitance or a larger ESR increase the deviation. For example, for a switching voltage regulator (which delivers output current via an output inductor and which includes an output capacitor connected in parallel across the load), a change in load current ($\Delta I_{load}$) results in a change in the regulator's output voltage unless 1) the current delivered to the load instantaneously increases by $\Delta I_{load}$, or 2) the capacitance of the output capacitor is so large and its ESR is so small that the output voltage deviation would be negligible. The first option is impossible because the current in the output inductor cannot change instantaneously. The time required to accommodate the change in load current can be reduced by reducing the inductance of the output inductor, but that eventually requires increasing the regulator's switching frequency, which is limited by the finite switching speed of the switching transistors and the dissipation in the transistors' driver circuit. The second option is possible, but requires a very large output capacitor which is likely to occupy too much space on a printed circuit board, cost too much, or both.

For applications requiring the regulator's output voltage to meet a narrow load transient response specification, i.e., a specification which narrowly limits the allowable output voltage deviation for a bidirectional step change in load current, this inevitable deviation may be unacceptably large. As used herein, "$\Delta V_{out}$" refers to a regulator's output voltage deviation specification, as well as to peak-to-peak output voltage deviations shown in graphs. The most obvious solution for improving load transient response is to increase the output capacitance and/or reduce the ESR of the output capacitor. However, as noted above, a larger output capacitor (which provides both more capacitance and lower ESR) requires more volume and more PC board area, and thereby more cost.

One approach to improving load transient response is shown in FIG. 1. A switching voltage regulator 10 includes a push-pull switch 12 connected between a supply voltage $V_{in}$ and ground, typically implemented with two synchronously switched power MOSFETs 14 and 16. A driver circuit 18 is connected to alternately switch on one or the other of MOSFETs 14 and 16. A duty ratio modulator circuit 20 controls the driver circuit; circuit 20 includes a voltage comparator 22 that compares a sawtooth clock signal received from a clock circuit 24 and an error voltage received from a error signal generating circuit 26. Circuit 26 typically includes a high-gain operational amplifier 28 that receives a reference voltage $V_{ref}$ at one input and a voltage representative of the output voltage $V_{out}$ at a second input, and produces an error voltage that varies with the difference between $V_{out}$ and the desired output voltage. The regulator also includes an output inductor L connected to the junction between MOSFETs 14 and 16, an output capacitor 30, shown represented as a capacitance C in series with an equivalent series resistance $R_e$, and a resistor $R_s$ connected between the output inductor and the output capacitor. $V_{out}$ is connected to drive a load 32.

In operation, MOSFETs 14 and 16 are driven to alternately connect inductor L to $V_{in}$ and ground, with a duty ratio determined by duty ratio modulator circuit 20; the duty ratio varies in accordance with the error voltage produced by error amplifier 28. The current in inductor L flows into the parallel combination of output capacitor 30 and load 32. The impedance of capacitor 30 is much smaller at the switching frequency than that of load 32, so that the capacitor filters out most of the AC components of the inductor current and virtually all of the direct current is delivered to load 32.

Without series resistor $R_s$, the voltage fed back to circuit 26 is equal to $V_{out}$, and the regulator's response to a step change in load current is that of a typical switching regulator; a regulator's output voltage $V_{out}$ is shown in FIG. 2*a* for a step change in load current $I_{load}$ shown in FIG. 2*b*. Because the current in L cannot change instantaneously, a sudden increase in $I_{load}$ causes $V_{out}$ to spike downward; the control loop eventually forces $V_{out}$ back to a nominal output voltage $V_{nom}$. Similarly, when $I_{load}$ later steps down, $V_{out}$ spikes up before returning to $V_{nom}$. The total deviation in output voltage $\Delta V_{out}$ for a step change in load current is determined by the difference between the two voltage spike peaks. If the regulator is subject to a narrow load transient response specification, this deviation may exceed the tolerance allowed.

Connecting resistor $R_s$ in series with inductor L (at an output terminal 34) can reduce $\Delta V_{out}$; one possible response with $R_s$ included is shown in FIG. 3*a* for a step change in load current shown in FIG. 3*b*. With $R_s$ in place, the control loop no longer causes $V_{out}$ to recover to $V_{nom}$; rather, $V_{out}$ recovers to a voltage given by the voltage at terminal 34 minus the product of $\Delta I_{load}$ and $R_s$. That is, the steady-state value of $V_{out}$ for a light load will be higher than it is for a heavy load, by $\Delta I_{load}*R_s$. Making $R_s$ approximately equal to the ESR of the output capacitor can provide a somewhat narrower $\Delta V_{out}$ than can be achieved without the use of $R_s$.

One disadvantage of the circuit of FIG. 1 is illustrated in FIGS. 4*a* and 4*b*. In this case, the load current (FIG. 4*b*) steps back down before $V_{out}$ (FIG. 4*a*) has settled to a steady-state value. With $V_{out}$ higher than it was in FIG. 3*a* at the instant $I_{load}$ falls, the peak of the upward $V_{out}$ spike is also higher, making the overall deviation $\Delta V_{out}$ greater than it would otherwise be. This larger deviation means that to satisfy a particular narrow output voltage deviation specification, regulator 10 must use a larger output capacitor that has a proportionally smaller ESR. The cost of a capacitor is approximately inversely proportional to its ESR, so that meeting the specification may be prohibitively expensive.

Another disadvantage of the FIG. 1 circuit is the considerable power dissipation required of series resistor $R_s$. For example, assuming an $R_s$ of 5 mΩ and a maximum load current of 14.6 A, the dissipation in $R_s$ will be 1.07 W.

An approach to improving a regulator's load transient response using a different control principle is disclosed in D. Goder and W. R. Pelletier, "$V^2$ Architecture Provides Ultra-Fast Transient Response in Switch Mode Power Supplies", HFPC Power Conversion, September 1996 Proceedings, pp. 19–23. The regulator described therein includes a push-pull switch, a driver circuit, an error amplifier, and an output inductor and capacitor similar to those shown in FIG. 1. A signal representing the regulator's output voltage is fed to both the error amplifier and to a voltage comparator which also receives the error amplifier's output. When the regulator's output voltage exceeds the output of the error amplifier, the comparator's output goes high and triggers a monostable multivibrator, which turns off the upper switching transistor for a predetermined time interval.

The transient response of this circuit is designed to be faster than that of the circuit in FIG. 1. A load current step immediately changes the voltage at the comparator, bypassing the sluggishness of the error amplifier and thereby shortening the response time. However, even with a shorter response time, the shape of the response trace still resembles that shown in FIG. 3*a*, with little to no improvement in the magnitude of $\Delta V_{out}$.

Another switching regulator is described in L. Spaziani, "Fueling the Megaprocessor—a DC/DC Converter Design Review Featuring the UC3886 and UC3910", Unitrode Application Note U-157, pp. 3-541 to 3-570. This regulator employs a control principle known as "average current control", in which regulation is achieved by controlling the average value of the current in the output inductor. A resistor is connected in series with the regulator's output inductor, and a current sense amplifier (CSE) is connected across the resistor to sense the inductor current. The output of the CSE is fed to a current error amplifier along with the output of a voltage error amplifier that compares the regulator's output voltage with a reference voltage. A comparator receives the output of the current error amplifier at one input and a sawtooth clock signal at its other input; the comparator produces a pulse-width modulated output to drive a push-pull switch via a driver circuit.

In operation, an increase in load current causes an output voltage decrease, increasing the error signal from the voltage error amplifier. This increases the output from the current error amplifier, which in turn causes the duty ratio of the pulses produced by the comparator to increase. This increases the current in the output inductor to bring up the output voltage. The voltage error amplifier is configured to provide a non-integrating gain, and this, in combination with average current control, gives the regulator a finite and controllable output resistance. This permits the output voltage to be positioned, similar to the way in which series resistor $R_s$ affected the response of the FIG. 1 circuit. However, as is clearly shown in FIG. 32 of the reference, the obtainable response again resembles that of FIG. 3*a*, with a $\Delta V_{out}$ that may still exceed a narrow output voltage deviation specification.

SUMMARY OF THE INVENTION

A method and circuit are presented which overcome the problems noted above, enabling a voltage regulator to provide an optimum response to a large bidirectional load transient while using the smallest possible output capacitor.

The invention is intended for use with voltage regulators for which output capacitor size and cost are preferably minimized, which must maintain its output voltage within specified boundaries for large bidirectional step changes in load current. These goals are achieved by employing an output capacitor that has a combination of the largest possible equivalent series resistance (ESR) and lowest possible capacitance that ensures that the peak-to-peak voltage deviation for a bidirectional step change in load current is no greater than the maximum allowed, and by compensating the regulator to ensure a response that is flat after the occurrence of the peak deviation—referred to herein as an "optimum response". When these conditions are met, the regulator's output capacitor will be the smallest possible capacitor which enables the output voltage to stay within the specified boundaries for a bidirectional step change in load current. The invention is applicable to both switching and linear voltage regulators.

Further features and advantages of the invention will be apparent to those skilled in the art from the following detailed description, taken together with the accompanying drawings.

DETAILED DESCRIPTION OF THE INVENTION

Figure 1:
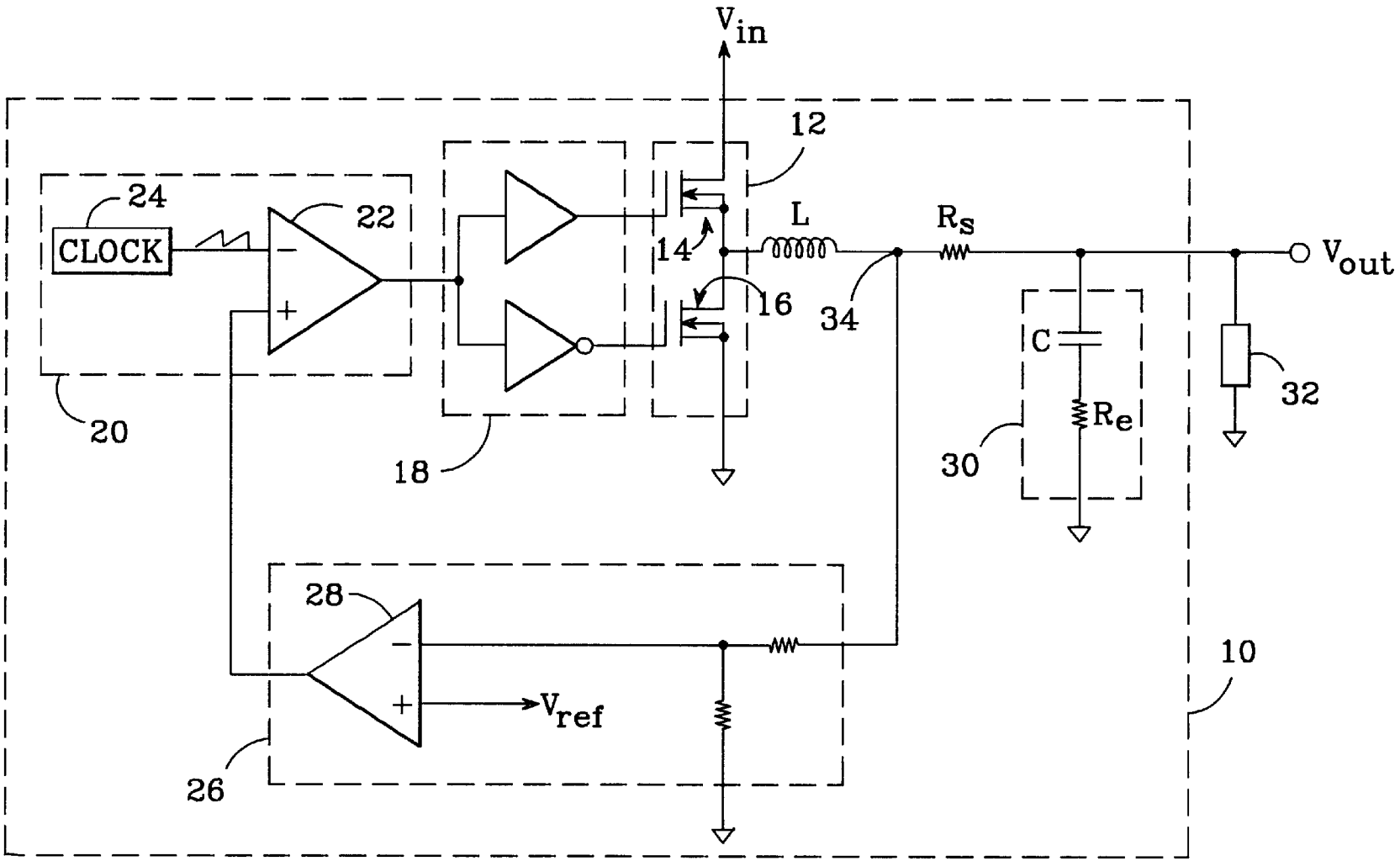
FIG.1 (Prior Art)
FIG. 1 is a schematic diagram of a prior art switching voltage regulator circuit.
Figure 2A:
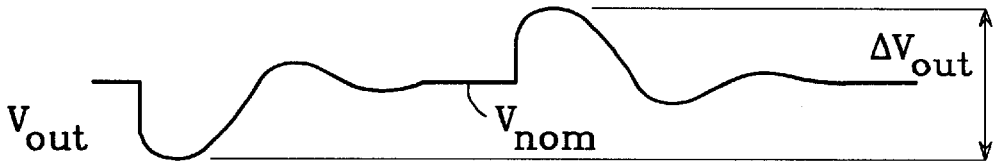
FIG.2a (Prior Art)
FIGS. 2*a* and 2*b* are plots of output voltage and load current, respectively, for a prior art voltage regulator circuit which does not include a resistor connected between its output terminal and its output capacitor.
Figure 2B:
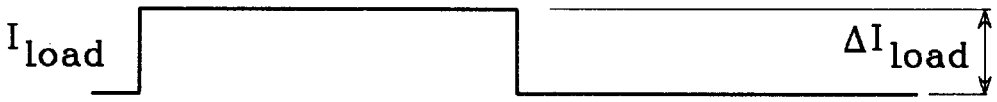
FIG.2b (Prior Art)
Figure 3A:
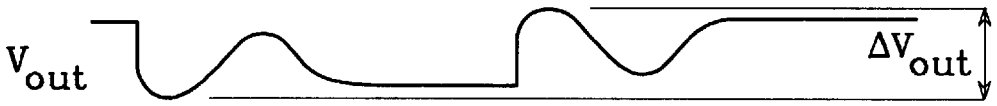
FIG.3a (Prior Art)
FIGS. 3*a* and 3*b* are plots of output voltage and load current, respectively, for a prior art voltage regulator circuit which does include a resistor connected between its output terminal and its output capacitor.
Figure 3B:
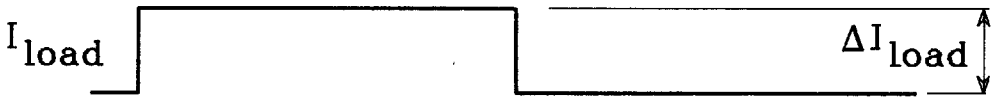
FIG.3b (Prior Art)
Figure 4A:
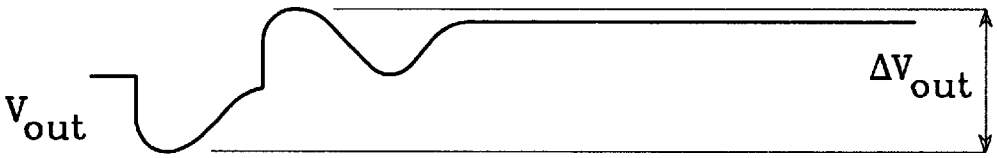
FIG.4a (Prior Art)
FIGS. 4*a* and 4*b* are plots of output voltage and load current, respectively, for a prior art voltage regulator circuit in which the load current steps down before the output voltage has settled in response an upward load current step.
Figure 4B:
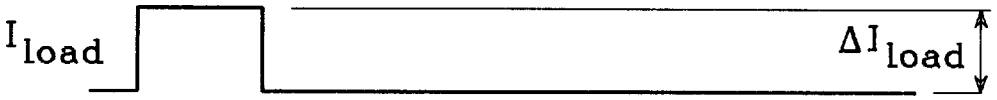
FIG.4b (Prior Art)

The present invention provides a means of determining the smallest possible capacitor that can be used on the output of a voltage regulator in applications requiring large bidirectional step-like changes in load current, which enables the regulator's output voltage to remain within specified boundaries for a given step size. A given step change in load current is identified herein as $\Delta I_{load}$ and the allowable output voltage deviation specification is identified as $\Delta V_{out}$. As used herein, the "smallest possible output capacitor" refers to the output capacitor having the smallest possible capacitance value and the largest permissible ESR value which enable the regulator to meet the $\Delta V_{out}$ specification. Because the cost of a capacitor tends to be inversely proportional to its ESR and directly proportional to its capacitance, and because space is nearly always at a premium on a circuit board, the invention makes it possible for the output capacitor's cost and space requirements to be minimized.

The invention takes advantage of the realization that there is a smallest possible output capacitor that, when used with a properly configured voltage regulator, enables the regulator to meet a given $\Delta V_{out}$ specification. Neglecting the effect of the output capacitor's equivalent series inductance, a step change in load current $\Delta I_{load}$ causes an initial change in the output voltage of a voltage regulator that is equal to the product of the capacitor's ESR (identified herein as $R_e$) and $\Delta I_{load}$; i.e., $R_e*\Delta I_{load}$. This initial change occurs for both upward and downward load current steps. If the output capacitor's capacitance C is equal to or greater than a certain "critical" value $C_{crit}$ (discussed in detail below), the output voltage deviation may not exceed the initial $R_e*\Delta I_{load}$ change. If C is less than $C_{crit}$, the output voltage deviation continues to increase after the initial $R_e*\Delta I_{load}$ change before beginning to recover.

Prior art regulators are typically designed to drive the output voltage back towards a nominal value after the occurrence of a load transient. Doing so, however, can result in an overall output voltage deviation $\Delta V_{out}$ of up to twice $R_e*\Delta I_{load}$: when the load current steps up, $V_{out}$ drops from the nominal voltage by $R_e*\Delta I_{load}$. If the load current stays high long enough, the regulator drives $V_{out}$ back toward the nominal voltage. Now when the load current steps back down, $V_{out}$ spikes up by $R_e*\Delta I_{load}$ resulting in a total output voltage deviation of $2(R_e*\Delta I_{load})$.

Having recognized the adverse implications of prior art regulator control methods on the magnitude of $\Delta V_{out}$, it was realized that an optimum load transient response—i.e., the response that produces the smallest output voltage deviation $\Delta V_{out}$—is a response which remains flat at the upper voltage deviation boundary after a downward load current step, and remains at the lower voltage deviation boundary after an upward load current step. The present invention provides a method of configuring the regulator so that its load transient response is at or near this theoretical optimum. Also realized was that the output capacitor needed to achieve this response is the smallest possible capacitor that can be used to meet the $\Delta V_{out}$ specification.

A number of steps must be performed to achieve the goal of providing the optimum response and thereby identifying the smallest possible capacitor which enables a given $\Delta V_{out}$ specification to be met. A maximum equivalent series resistance $R_{e(max)}$ is first determined for the output capacitor that will be employed by a voltage regulator subject to a specified voltage deviation specification $\Delta V_{out}$ for a bidirectional step change in load current $\Delta I_{load}$. In accordance with Ohm's Law, $R_{e(max)}$ is given by: $R_{e(max)}=\Delta V_{out}/\Delta I_{load}$; if the output capacitor's $R_e$ is any greater than $R_{e(max)}$, the initial deviation in $V_{out}$ for a step change in load current equal to $\Delta I_{load}$ is guaranteed to exceed $\Delta V_{out}$.

The next step is to determine the "critical" capacitance value $C_{crit}$ mentioned above. The critical capacitance is the amount of capacitance that, when connected in parallel across a load driven by a voltage regulator (as the regulator's output capacitor), causes the output voltage to have a zero slope—i.e., to become flat after the initial $R_e*\Delta I_{load}$ change—when the current injected by the regulator towards the parallel combination of load and output capacitor ramps up (or down) with the maximum slope allowed by the physical limitations of the regulator. The maximum slope allowed by the physical limitations of the regulator is referred to herein as the "maximum available slope".

The critical capacitance $C_{crit}$ is given by:

$$C_{crit}=\Delta I_{load}/mR_{e(max)} \quad \text{(Eq. 1)}$$

where $\Delta I_{load}$ is the largest expected load current step, $R_{e(max)}$ is the maximum allowable output capacitor ESR (calculated above), and m is a slope value associated with the current injected toward the parallel combination of the output capacitor and output load; m and the method of determining its value are discussed below.

Figure 5A:
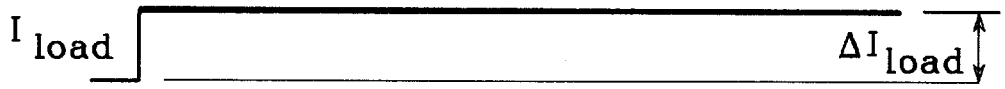
FIG. 5*a* is a plot of a step change in load current.
Figure 5B:
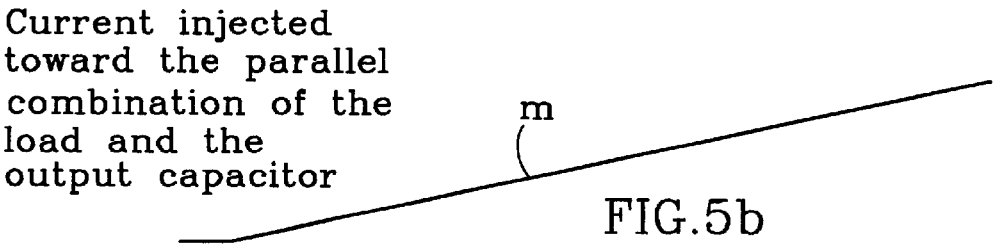
FIG. 5*b* is a plot of the output current injected by a voltage regulator toward the parallel combination of output capacitor and output load in response to the step change in load current shown in FIG. 5*a*.
Figure 5C:
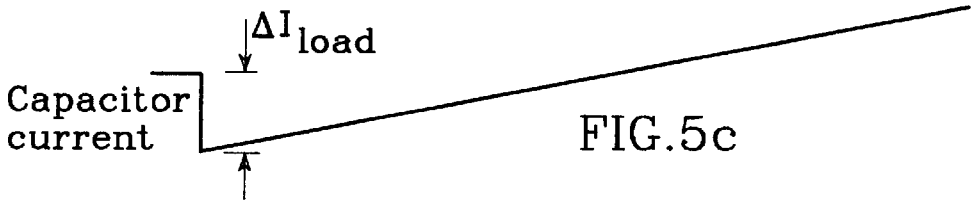
FIG. 5*c* is a plot of a voltage regulator's output capacitor current in response to the step change in load current shown in FIG. 5*a*.

The slope parameter m is illustrated in FIGS. 5*a*–5*c*. FIG. 5*a* depicts the load current waveform for an upward step. FIG. 5*b* shows the current injected by the regulator toward the parallel combination of output capacitor and output load when the regulator produces output current at the maximum available slope m. FIG. 5*c* shows the current in the output capacitor, which is equal to the difference between the load current and the injected current.

Figure 5D:
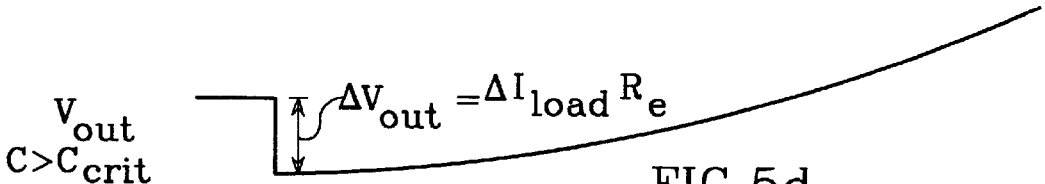
FIG. 5*d* is a plot of a voltage regulator's output voltage when the capacitance of its output capacitor is greater than a critical capacitance $C_{crit}$.
Figure 5E:
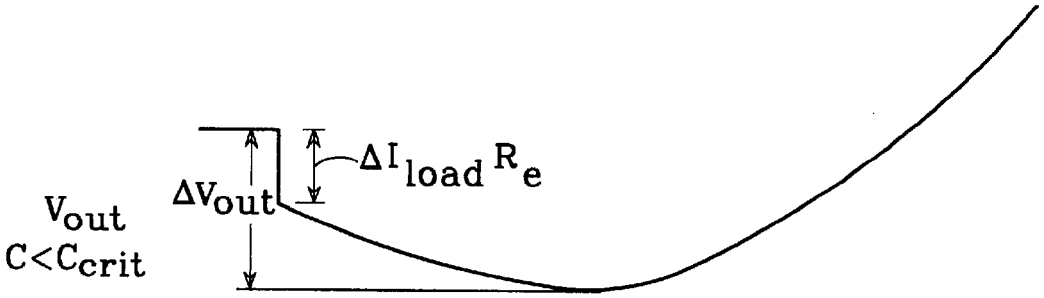
FIG. 5*e* is a plot of a voltage regulator's output voltage when the capacitance of its output capacitor is less than a critical capacitance $C_{crit}$.

FIGS. 5*d* and 5*e* illustrate how the size of a regulator's output capacitor affects $V_{out}$ when its capacitance C is greater than $C_{crit}$ (FIG. 5*d*) and less than $C_{crit}$ (FIG. 5*e*), and the regulator injects a current toward the parallel combination of capacitor and load with the maximum available slope. When $C>C_{crit}$, $V_{out}$ begins to recover immediately after the occurrence of the initial $\Delta I_{load}R_e$ change. However, when $C<C_{crit}$, the output voltage deviation continues to increase after the initial $\Delta I_{load}R_e$ change, before eventually recovering.

The slope value m for a given regulator depends on its configuration. In general, m is established by:

1) determining the absolute value of the maximum available slope of the current injected by the voltage regulator toward the parallel combination of the output load and output capacitor for a step increase in load current equal to $\Delta I_{load}$,
2) determining the absolute value of the minimum available slope of the current injected toward the parallel combination of the output load and output capacitor for a step decrease in load current equal to $\Delta I_{load}$. A step decrease in load current results in an injected current which has a negative slope. For this step, then, the "minimum available slope . . . for a step decrease in load current" is equal to the most negative slope, 3) determining which of the two absolute values is smaller—this is the "worst case" maximum available slope. The smaller of the two absolute values is the value m which is to be used in the equations found herein.

In a switching regulator, the worst-case maximum available slope m is clearly defined by its input voltage $V_{in}$, its output voltage $V_{out}$, and the inductance L of its output inductor. For example, for a buck-type voltage regulator, m can be determined in accordance with the following: when $V_{out}$ is less than $V_{in}-V_{out}$, m is given by $m=V_{out}/L$. When $V_{out}$ is greater than $V_{in}-V_{out}$, m is given by $m=(V_{in}-V_{out})/L$.

For linear voltage regulators, the worst-case maximum available slope is not as clearly defined. It will depend on a number of factors, including the compensation of its voltage error amplifier, the physical characteristics of its semiconductor devices, and possibly the value of the load current as well.

Figure 6A:
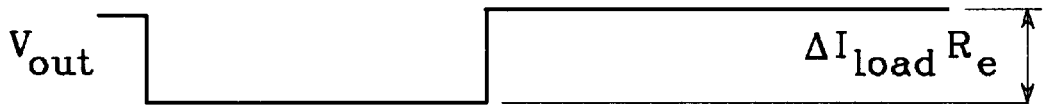
FIGS. 6*a* and 6*b* are plots of output voltage and load current, respectively, for a voltage regulator per the present invention which employs an output capacitance that is equal to or greater than a critical capacitance $C_{crit}$.
Figure 6B:
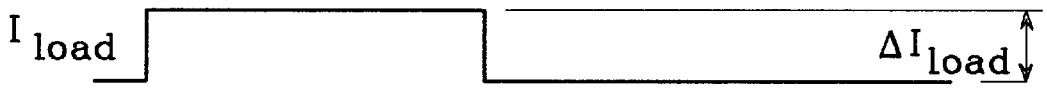
Figure 7A:
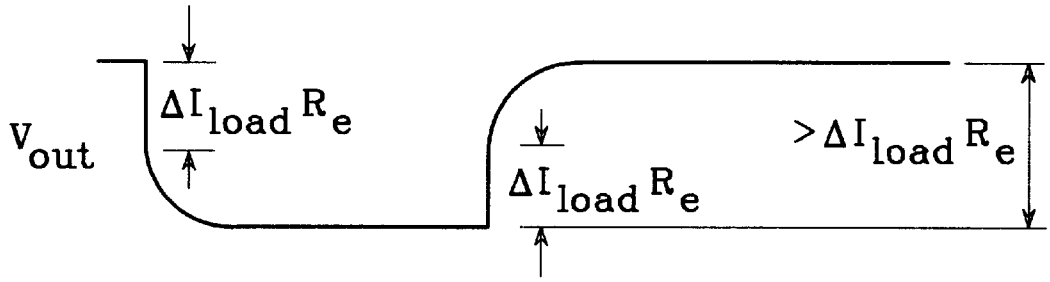
FIGS. 7*a* and 7*b* are plots of output voltage and load current, respectively, for a voltage regulator per the present invention which employs an output capacitance that is less than a critical capacitance $C_{crit}$.
Figure 7B:
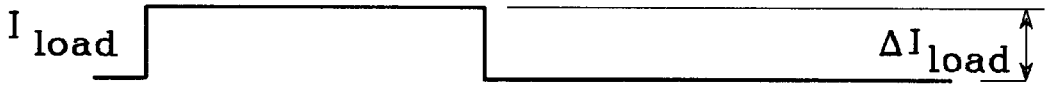

The two optimum load transient responses achievable with the present invention are depicted in FIGS. 6 and 7. FIG. 6*a* depicts the optimum load transient response to a bidirectional step in load current shown in FIG. 6*b*, for a properly configured regulator when the capacitance C of its output capacitor is equal to or greater than $C_{crit}$. Because C is equal to or greater than $C_{crit}$, the maximum output voltage deviation is limited to $R_e*\Delta I_{load}$. FIG. 7*a* shows the optimum load transient response to a bidirectional step change in load current $\Delta I_{load}$ in FIG. 7*b*, when the capacitance of a properly configured regulator's output capacitor is less than $C_{crit}$. After the initial step ($=\Delta I_{load}*R_e$) caused by the capacitor's $R_e$, $V_{out}$ gradually declines to a steady-state value, and then remains flat at the steady-state value until the load current steps back down. It can be shown that the peak voltage deviation $\Delta V_{out}$ in this case is given by:

$$\Delta V_{out}=\Delta I_{load}^2/2mC+mCR_e^2/2 \quad \text{(Eq. 2)}$$

where m and $\Delta I_{load}$ are the same as in equation 1, and C and $R_e$ are the capacitance and ESR, respectively, of the output capacitor employed. If a capacitor with a capacitance less than $C_{crit}$ must be used, the invention still provides a method that ensures that the peak voltage deviation given by equation 2 is not exceeded. Thus, as used herein, an "optimum response" for a regulator having an output capacitor with a capacitance greater than $C_{crit}$ is as shown in FIG. 6*a*, in which the regulator responds to a load current step of size $\Delta I_{load}$ with an initial output voltage deviation equal to $\Delta I_{load}*R_e$, and then remaining flat until the next load current step. When the output capacitor has a capacitance less than $C_{crit}$, an optimum response is as shown in FIG. 7*a*, with a peak output voltage deviation given by equation 2, and then remaining flat until the next load current step.

Once the value of m has been determined for a given regulator, the minimum size capacitor that provides an optimum response (per FIG. 6*a* or FIG. 7*a*) can be determined. The minimum size capacitor is one which has a combination of capacitance C and ESR $R_e$ that satisfies the following equation:

$$C_{min}=[\Delta I_{load}^2/2m+mT_c^2/2]\Delta V_{out} \quad \text{(Eq. 3)}$$

where m is the slope value calculated above, $\Delta V_{out}$ is the maximum allowed voltage deviation for a step change in load current equal to $\Delta I_{load}$, and $T_c$ is a characteristic time constant (discussed below).

For any given capacitor type, there exists a minimum size that satisfies equation 3. Capacitor types include, for example, aluminum (Al) electrolytic capacitors, ceramic capacitors, and OS-CON (Al with an organic semiconductive electrolyte) capacitors. The selection of an output capacitor type is driven by a number of factors. For a switching regulator, one important consideration is switching frequency. Low-frequency designs (e.g., 200 kHz) tend to use Al electrolytic capacitors, medium-frequency designs (e.g., 500 kHz) tend to use OS-CON capacitors, and high-frequency designs (1 MHz and above) tend to use ceramic capacitors.

Once a capacitor type has been selected, its characteristic time constant $T_c$ is determined, which is given by the product of its ESR and its capacitance. Because a capacitor's ESR tends to decrease as its capacitance increases, $T_c$ tends to be about constant for capacitors of a given type and voltage rating. For example, standard low-voltage (e.g., 10 V) Al electrolytic capacitors have characteristic time constants of about 40 $\mu$s (e.g., 2 mF×20 mΩ), ceramic capacitors have characteristic time constants of about 100 ns (e.g., 10 $\mu$F×10 mΩ), and OS-CON capacitors have characteristic time constants of about 4 $\mu$s (e.g., 100 $\mu$F×40 mΩ).

With $T_c$ determined for the selected capacitor type, a minimum capacitance is established in accordance with equation 3. A maximum ESR $R_{e(max)}$ is then given by:

$$R_{e(max)}=T_c/C_{min}.$$

capacitor having a capacitance C equal to or preferably, greater than $C_{min}$, and an ESR $R_e$ equal to or, preferably, slightly less than $R_{e(max)}$ is used as the regulator's output capacitor. If C is equal to or greater than the $C_{crit}$ value calculated above, a response per FIG. 6*a* is obtained; if C is less than $C_{crit}$, a response per FIG. 7*a* is achieved. Using an output capacitor having a capacitance equal to $C_{min}$ and an ESR equal to $R_{e(max)}$ is permissible, but is not recommended. Doing so is a poor design practice which leaves no safety margin against tolerances and changes with age, temperature, etc. On the other hand, selecting a capacitor with an ESR that is much smaller than $R_{e(max)}$ is also not recommended, since a capacitor with a lower ESR tends to cost more. Note that once the output capacitor's ESR value is established, its capacitance C is largely determined by the choice of capacitor type. As such, C may be much greater than $C_{crit}$, but within the selected capacitor type the size of the capacitor is still minimal.

Having selected the output capacitor, the voltage regulator needs to be configured such that its response will have the optimum shape shown in FIG. 5*a* (if $C>C_{crit}$) or FIG. 6*a* (if $C<C_{crit}$). If $C>C_{crit}$, the optimum response is achieved by configuring the voltage regulator such that its output impedance (including the impedance of the output capacitor) becomes resistive and equal to the ESR of the output capacitor. If $C<C_{crit}$, the optimum response is ensured only by forcing the regulator to inject current to the combination of the load and the output capacitor with the maximum available slope until the peak deviation is reached. For this case an optimum output impedance cannot be defined because the regulator operates in a nonlinear mode for part of the response, but the output impedance can still be selected to provide an approximately optimal response.

Figure 8:
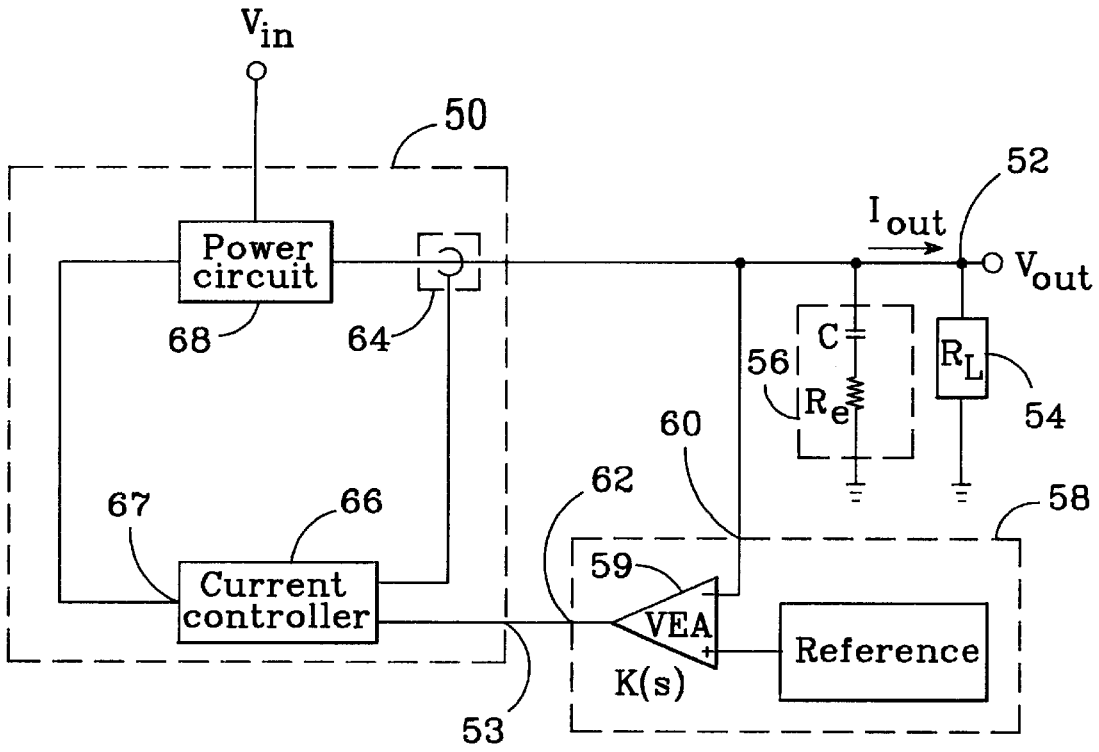
FIG. 8 is a block/schematic diagram of an embodiment of a voltage regulator per the present invention.

One embodiment of a voltage regulator per the present invention is shown in FIG. 8. A controllable power stage 50 is characterized by a transconductance g and produces an output $V_{out}$ at an output node 52 in response to a control signal received at a control input 53; power stage 50 drives a load 54. An output capacitor 56 is connected in parallel across the load, here shown divided into its capacitive C and equivalent series resistance $R_e$ components. A feedback circuit 58 is connected between output node 52 and control input 53.

Feedback circuit 58 can include, for example, a voltage error amplifier 59 connected to receive a signal representing output voltage $V_{out}$ at a first input 60 and a reference voltage at a second input, and producing an output 62 which varies with the differential voltage between its inputs. For the embodiment shown in FIG. 8, an optimum load transient response—i.e., per FIG. 6*a* if capacitor 56 is equal to or greater than $C_{crit}$ and per FIG. 7*a* is capacitor 56 is less than $C_{crit}$—is achieved by compensating voltage error amplifier 59 such that its gain K(s) is given by:

$$K(s)=-(1/gR_o)(1/(1+sR_eC)) \quad \text{(Eq. 4)}$$

where g is the transconductance of the controllable power stage 50, C and $R_e$ are the capacitance and ESR of output capacitor 56, respectively, s is the complex frequency, and $R_o$ is a quantity given by:

$$R_o=R_e, \text{ if } C\geqq C_{crit}, \text{ or} \quad \text{(Eq. 5)}$$

$$R_o=(\Delta I_{load}/2mC)+(mCR_e^2/2\Delta I_{load}), \text{ if } C<C_{crit} \quad \text{(Eq. 6)}$$

where C and $R_e$ are the capacitance and ESR of output capacitor 56, respectively, m is the absolute value of the smallest slope of the current injected toward the parallel combination of output capacitor 56 and load 54 (as discussed in connection with the determination of $C_{crit}$), and $\Delta I_{load}$ is the largest load current step which the regulator is designed to accommodate.

The value of $R_o$ defined in equations 5 and 6 is a measure of the peak voltage deviation of the regulator. When C is greater than or equal to $C_{crit}$, and the gain K(s) of voltage error amplifier 59 is as defined in equation 4, the combined output impedance of the regulator and the output capacitor 56 will be equal to the equivalent series resistance $R_e$ of the output capacitor. Therefore, the peak voltage deviation will be $\Delta I_{load}*R_o$, which is equal to $\Delta I_{load}*R_e$ when $C\geqq C_{crit}$.

When C is less than $C_{crit}$, and the gain K(s) of voltage error amplifier 59 is as defined in equation 4, the peak voltage deviation $\Delta V_{out}$ will be as defined in equation 2. The system is nonlinear when C is less than $C_{crit}$, and as such the regulator cannot achieve the optimal transient response shown in FIG. 6*a*. However, compensating voltage error amplifier 59 to yield the transfer function given by equation 4 provides a transient response that is as close to FIG. 6*a*'s ideal response as practically possible.

Controllable power stage 50 is not limited to any particular configuration. In FIG. 8, power stage 50 is configured to provide current-mode control; the power stage includes a current sensor 64 which has a transresistance equal to $R_s$ and which produces an output signal that varies with the power stage's output current, a current controller 66 which receives the output of the current sensor and the output 62 of the voltage error amplifier as inputs and produces an output 67, and a power circuit 68 which receives output 67 from the current controller and produces output voltage $V_{out}$ in response. The invention is applicable to both linear and switching regulators: in linear regulators, power circuit 68 is a series pass transistor and current controller 66 is an amplifier. For a switching regulator, power circuit 68 can have any of a large number of topologies, containing components such as controlled switches, diodes, inductors, transformers, and capacitors. For example, a typical power circuit for a buck-type switching regulator is shown in FIG. 1, which includes a pair of controlled switches 14 and 16 and an output inductor L connected between the junction of the switches and the regulator's output.

The current controller 66 for a switching regulator can be of two types: instantaneous and average. Instantaneous current control has at least six different subtypes, as described, for example, in A. S. Kislovski, R. Redl, and N. O. Sokal, *Dynamic analysis of switching-mode DC/DC converters*, Van Nostrand Reinhold (1991), p. 102, including constant off-time peak current control, constant on-time valley current control, hysteretic control, constant frequency peak current control, constant frequency valley current control, and PWM conductance control. Instantaneous current controllers can typically change the current in the output inductor within one switching period, while changing the inductor current with average current control usually takes several periods. For this reason, instantaneous current control is preferred, but average current controllers can also be used to implement the present invention if the current-controlling loop has sufficiently fast response; however, such implementations suffer from the drawback of requiring a current error amplifier, which increases the complexity and cost of the regulator circuit.

Figure 9:
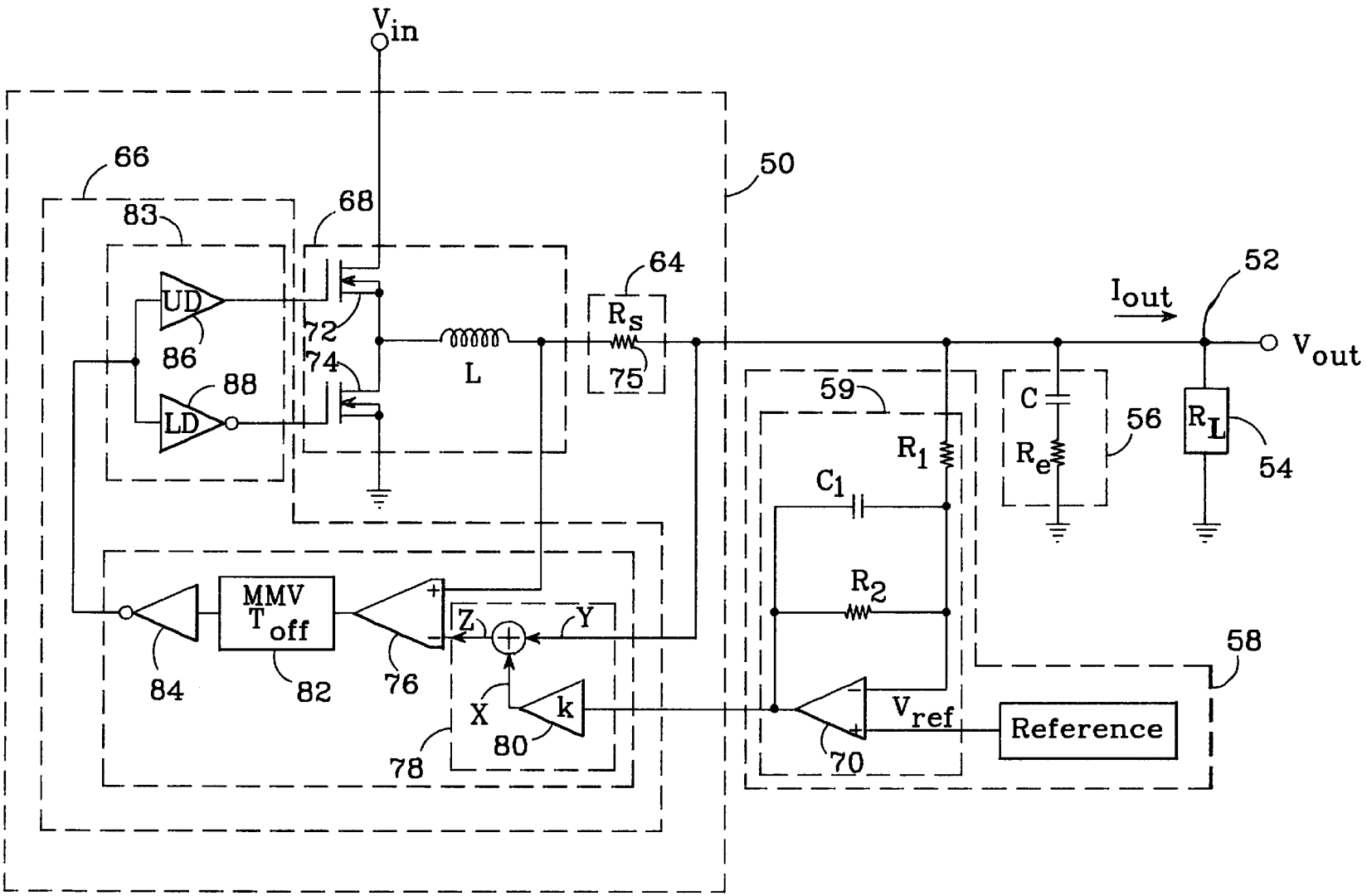
FIG. 9 is a schematic diagram of one possible implementation of the voltage regulator embodiment shown in FIG. 8.

FIG. 9 is a schematic diagram of one possible implementation of a switching voltage regulator per the present invention. In this embodiment, feedback circuit 58 includes voltage error amplifier 59, which is made up of an operational amplifier 70, an input resistor $R_1$, a feedback resistor $R_2$, and a feedback capacitor $C_1$. Power circuit 68 includes a pair of switches 72 and 74 connected between $V_{in}$ and ground, with the junction between the switches connected to an output inductor L. Current sensor 64 is implemented with a resistor 75 having a resistance $R_s$, connected in series between inductor L and output node 52.

Current controller 66 is a constant off-time peak current control type controller, which includes a voltage comparator 76 with its inputs connected to the inductor side of resistor 75 and to the output of a summing circuit 78. Summing circuit 78 produces a voltage at its output Z that is equal to the sum of the voltages at its X and Y inputs; X is connected to receive the output 62 of voltage error amplifier 59, and Y is connected to the output side of current sense resistor 75. Summing circuit 78 can also include a gain stage 80 having a fixed gain k, connected between the output of voltage error amplifier 59 and its X input; the gain k should be significantly less than unity e.g. 0.01—if the output voltage $V_{out}$ and the reference voltage $V_{ref}$ are expected to be nearly equal. The output of comparator 76 is connected to a monostable multivibrator 82, the output of which is fed to a driving circuit 83 via a logic inverter 84. Driving circuit 83 includes upper driver 86 and lower driver 88, which drive switches 72 and 74, respectively, of power circuit 68.

The operation of the switching regulator circuit of FIG. 9 is as follows: when the product of the current in inductor L and the resistance $R_s$ of resistor 75 exceeds the error voltage produced by voltage error amplifier 59, the output of voltage comparator 76 goes high and triggers monostable multivibrator 82. Logic inverter 84 inverts the high output of multivibrator 82, which causes upper driver 86 to turn off upper switch 72 and lower driver 88 to turn on lower switch 74. As a result, the current in inductor L begins to decrease. Monostable multivibrator 82 has an associated timing interval $T_{off}$; after timing interval $T_{off}$ has expired, the states of switches 72 and 74 reverse, and the current in inductor L begins to increase. When the inductor current exceeds the threshold of comparator 76, the cycle repeats. Output voltage regulation is achieved by changing the threshold of voltage comparator 82 with the error voltage from error amplifier 59 via summing circuit 78.

Figure 10A:
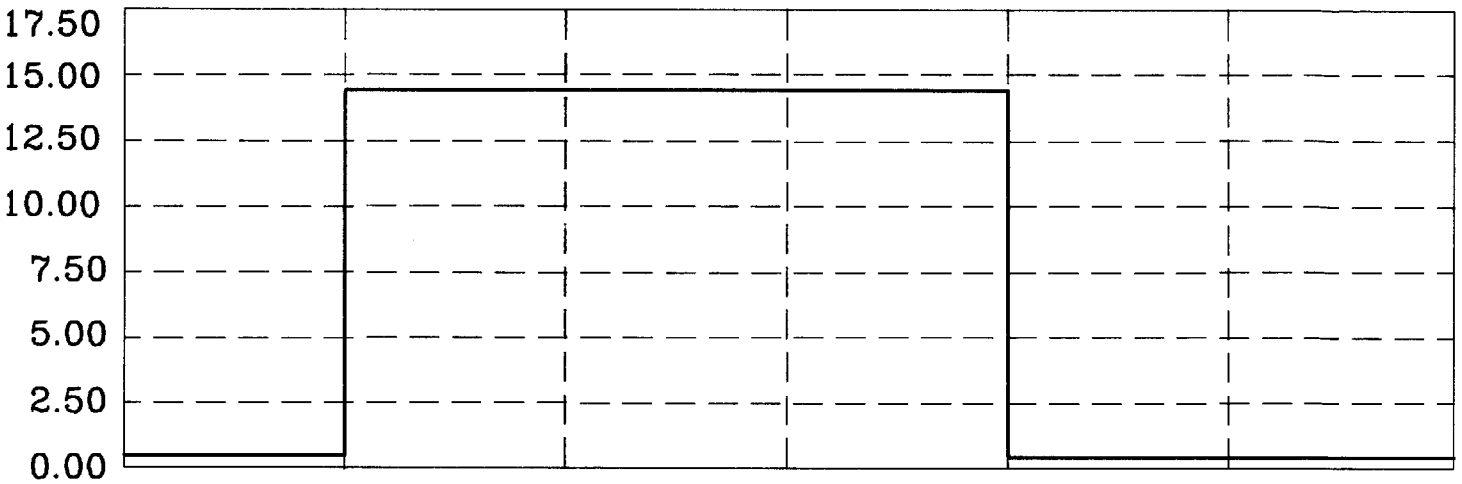
FIGS. 10*a* and 10*b* are simulated plots of output voltage and load current, respectively, for a voltage regulator per FIG. 9.
Figure 10B:
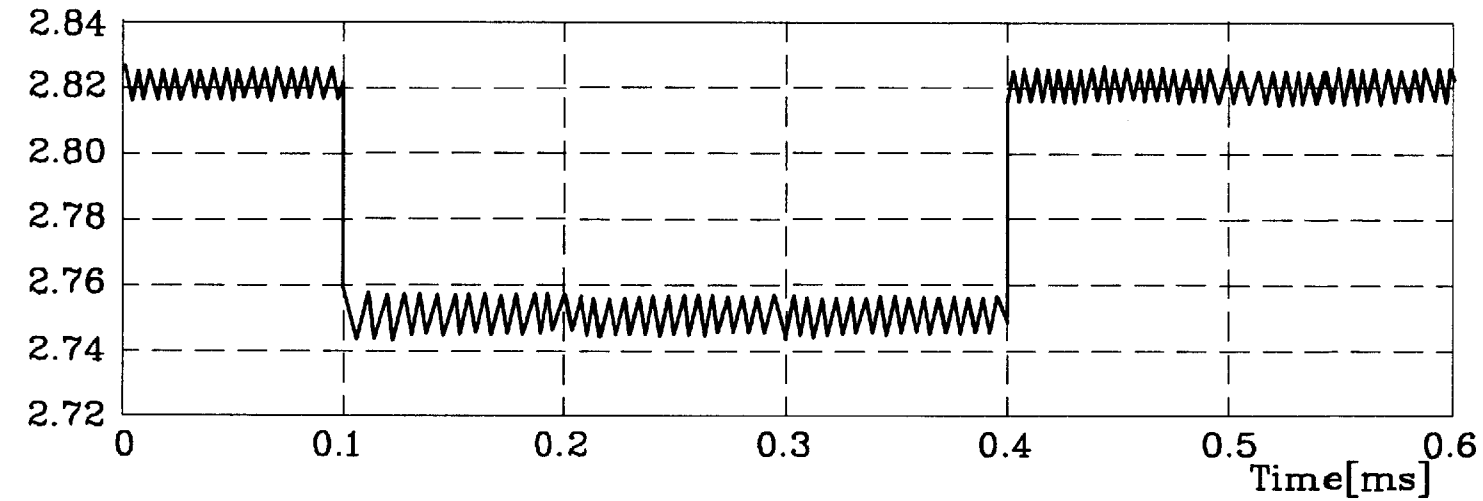

When configured per the present invention, the switching voltage regulator of FIG. 9 provides a nearly optimum load transient response, as illustrated in the simulated plots of load current $I_{load}$ and output voltage $V_{out}$ shown in FIGS. 10*a* and 10*b*, respectively. In this example, the load current changes from 0.56 A to 14.56 A and back ($\Delta I_{load}$=14 A) and the allowable output voltage deviation $\Delta V_{out}$ is 0.07 V. The parameter values of the switching regulator are as follows: $V_{in}$=5 V; $V_{ref}$=2.8 V; L=3 $\mu$H; C=10 mF; $R_e$=5 mΩ; $R_s$=5 mΩ; k=0.01; $\Delta I_{load}$–14 A; $\Delta V_{out}$=0.07 V.

Note that the output capacitor's $R_e$ is within the acceptable range defined by $R_{e(max)}=\Delta V_{out}/\Delta I_{load}$, equal here to 0.07V/14 A=5 mΩ.

For this example, $V_{out}(=V_{ref})$ is greater than $V_{in}-V_{out}$, so that m is given by:

$m=(V_{in}-V_{out})/L=[(5-2.8)V]/3pH=0.733\ A/\mu s$.

From equation 1, the critical capacitance $C_{crit}$ is given by:

$C_{crit}=14\ A/[(0.733\ A/\mu s)(5\ m\Omega)]=3.818\ mF$.

Since 10 mF is greater than 3.818 mF, C is greater than $C_{crit}$ and thus $R_o$ (as given by equation 5) is to be made equal to $R_e$. This is accomplished by compensating voltage error amplifier 59 as needed to obtain the transfer function of equation 4. When voltage error amplifier 59 is implemented as shown in FIG. 9, this compensation is achieved when the following two equations are satisfied:

$$k^*(R2/R1)=1/(g^*R_o) \quad \text{(Eq. 7)}$$

$$R_e{}^*C=R2^*C1 \quad \text{(Eq. 8)}$$

The value of g is determined by the transresistance of current sensor 64 and the implementation of current controller 66. If the first stage of the current controller is a voltage comparator (as here), g is equal to the reciprocal of the transresistance of current sensor 64. When the current sensor is implemented with a resistor, the transresistance is simply the resistor's resistance (thus, $g=1/R_s$ in this example). In this example, equations 7 and 8 are satisfied when the following component values are used:

$R_1$=1 kΩ; $R_2$=100 kΩ; C1=500 pF. As the waveform of FIG. 10*b* shows, the output voltage response corresponds to a resistive output impedance of 5 mΩ, which is also equal to the ESR of the output capacitor.

Figure 11:
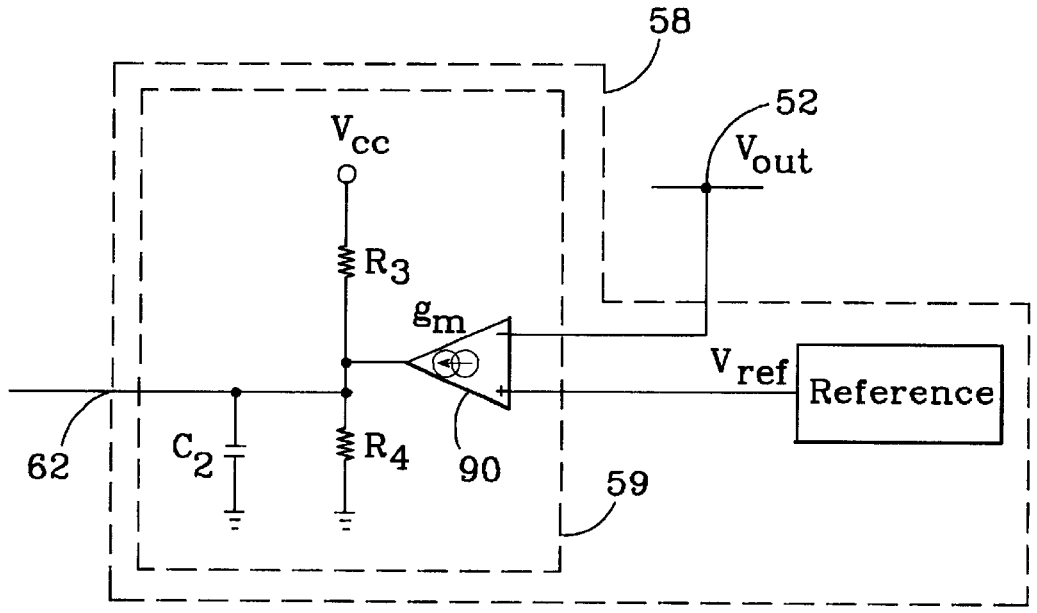
FIG. 11 is a schematic diagram of alternative implementation of the voltage error amplifier shown in FIG. 9.

An alternative implementation of feedback circuit 58 is shown in FIG. 11, in which voltage error amplifier 59 is implemented using a transconductance amplifier 90. A transconductance amplifier is characterized by an output current that is proportional to the voltage difference between its non-inverting and inverting inputs; the proportionality factor between the output current and the input difference voltage is the amplifier's transconductance $g_m$. The voltage gain of a transconductance-type voltage error amplifier is equal to the product of the impedance connected to the output of transconductance amplifier 90 and the transconductance $g_m$.

The voltage error amplifier implementations shown in FIGS. 9 and 11 are equivalent when the following three equations are satisfied:

$$g_m[(R_3R_4)/(R_3+R_4)]=R_2/R_1 \quad \text{(Eq. 9)}$$

$$V_{cc}[R_4/(R_3+R_4)]=V_{ref} \quad \text{(Eq. 10)}$$

$$C_2[(R_3R_4)/(R_3+R_4)]=C_1R_2 \quad \text{(Eq. 11)}$$

Thus, the transfer function defined in equation 4 is obtained for voltage error amplifier 59 shown in FIG. 11 when each of equations 9, 10 and 11 are satisfied.

Figure 12:
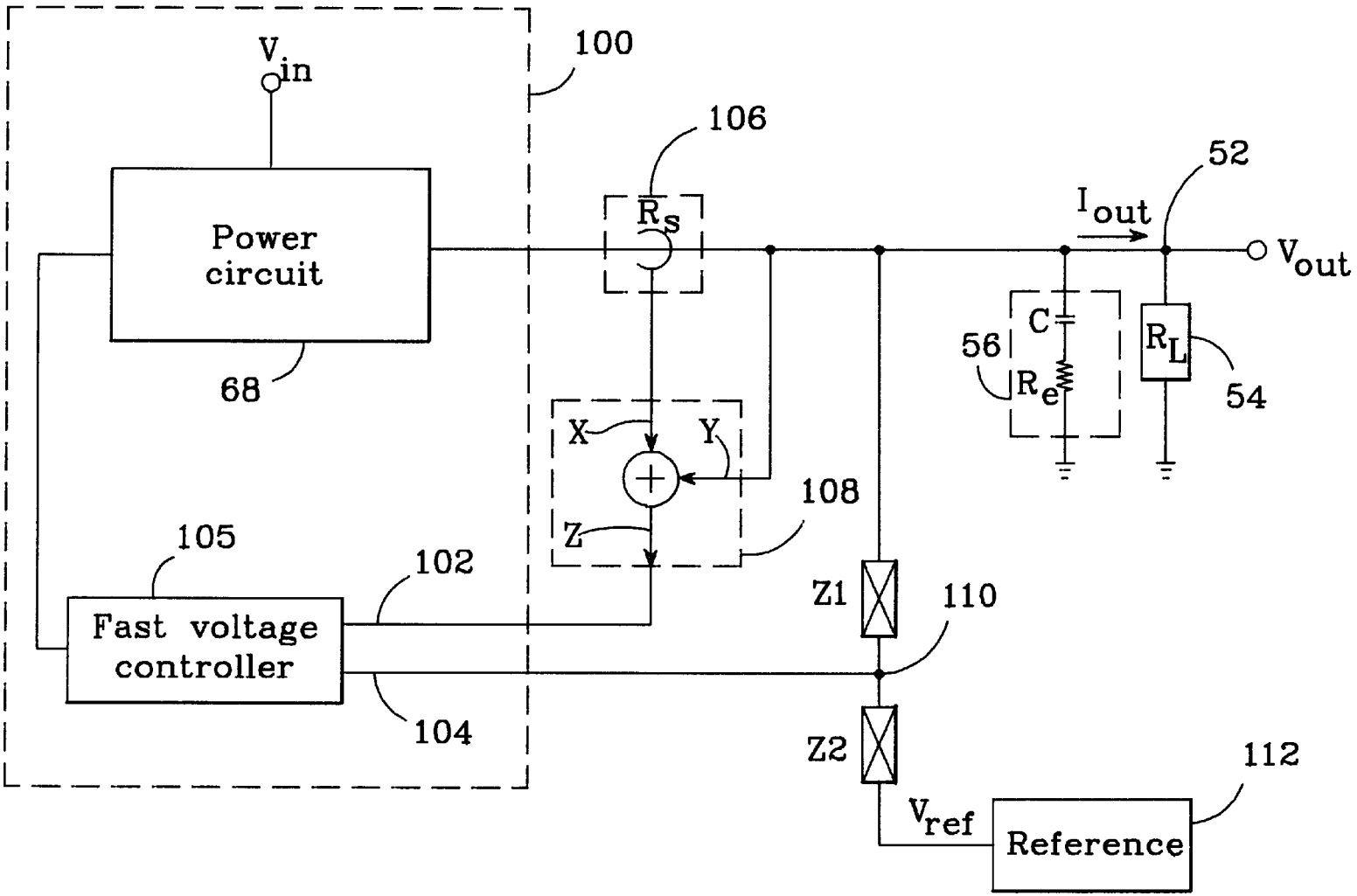
FIG. 12 is a block/schematic diagram of another embodiment of a voltage regulator per the present invention.

The invention is not limited to use with current-mode controlled voltage regulators that include a voltage error amplifier. One possible embodiment of the invention which uses neither current-mode control nor a voltage error amplifier is shown in FIG. 12. In this embodiment, a controllable power stage 100 produces an output voltage $V_{out}$ in accordance with the voltage difference between a pair of inputs 102, 104; the power stage includes a power circuit 68 controlled by a fast voltage controller 105 which receives the inputs. In a switching voltage regulator, fast voltage controller 105 is characterized by rapidly increasing the duty ratio of the pulse train at its output when an appreciable positive voltage difference appears between inputs 102 and 104. In a linear voltage regulator, fast voltage controller 105 would typically be implemented with a wide-band operational amplifier.

The embodiment of FIG. 12 also includes a current sensor 106 having a transresistance $R_s$ connected in series between the output of the power stage 100 and output node 52, which produces an output that varies with the regulator's output current. The current sensor's output is connected to one input of a summing circuit 108, and a second summing circuit input is connected to output node 52. The summing circuit produces an output voltage equal to the sum of its inputs, which is connected to input 102 of power stage 100.

Input 104 of power stage 100 is connected to a node 110 located at the junction between a pair of impedances Z1 and Z2, which are connected in series between output node 52 and a voltage reference 112. When a regulator is configured as shown in FIG. 12, an optimal transient response is obtained by arranging the ratio between the two impedances Z2/Z1 in accordance with the following:

$$Z2/Z1=[R_o(1+sR_eC)-R_s]/R_s \quad \text{(Eq. 12)}$$

where $R_o$ is defined by equations 5 and 6, $R_s$ is the resistance of current sensor 106, and $R_e$ and C are the ESR and capacitance of the output capacitor 56 employed.

Figure 13:
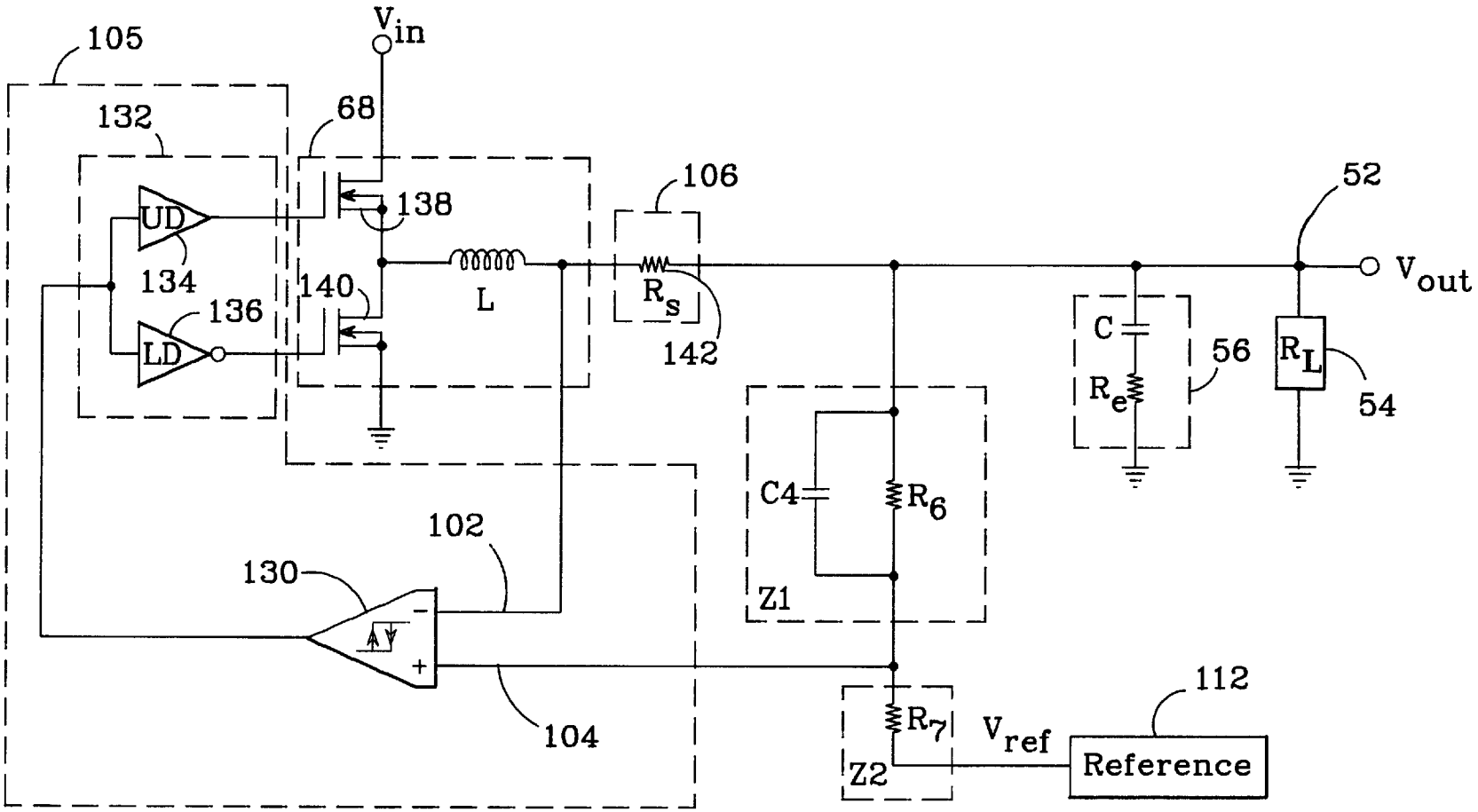
FIG. 13 is a schematic diagram of one possible implementation of the voltage regulator embodiment shown in FIG. 12.

One implementation of the voltage regulator embodiment of FIG. 12 is shown in FIG. 13. Fast voltage controller 105 is implemented with a hysteretic comparator 130, the output of which is connected to a driving circuit 132 which includes an upper driver 134 and a lower driver 136. Power circuit 68 includes an upper switch 138 and a lower switch 140, which are driven by drivers 134 and 136, respectively, and an output inductor L is connected to the junction between the switches. The hysteretic comparator 130 monitors the output voltage and turns off the upper switch when the output voltage exceeds the upper threshold of the comparator. The upper switch is turned on again when the output voltage drops below the comparator's lower threshold.

Current sensor 106 and summing circuit 108 are implemented with a series resistor 142 having a resistance $R_s$. Impedance Z1 is implemented with a parallel combination of a capacitor $C_4$ and a resistor $R_6$, and impedance Z2 is implemented with a resistor $R_7$.

For the output impedance of the switching regulator of FIG. 13 to be equal to the resistance $R_o$, the ratio of the resistances of resistors $R_6$ and $R_7$ must be given by:

$$R_7/R_6=(R_o-R_s)/R_s.$$

and the product of the capacitance of capacitor $C_4$ and the resistance of resistor $R_6$ must be given by:

$$C_4R_6=C[(R_oR_e)/R_s].$$

As is readily apparent to those skilled in the art of voltage regulator design, the voltage regulator embodiments and implementations discussed above are merely illustrative. Many other circuit configurations could be employed to achieve the invention's goals of optimum transient response and smallest possible output capacitor, as long as the inventive method is practiced as described herein.

The inventive method described herein can be presented as a general design procedure, applicable to the design of both linear and switching voltage regulators and accommodating the use of output capacitors having capacitances that are both greater than and less than the critical capacitance defined above. This design procedure can be practiced in accordance with the following steps:

1. Select a type of capacitor (such as Al electrolytic, ceramic, and OS-CON capacitors) to be used as the output capacitor for a voltage regulator required to maintain a regulated output voltage within a specified voltage deviation specification $\Delta V_{out}$ for a step change in load current $\Delta I_{load}$.

2. Determine the characteristic time constant $T_c$ for the selected capacitor type, which as explained above, is defined as the product of its ESR and its capacitance.

3. Determine the absolute value of the maximum available slope of the current injected by the voltage regulator toward the parallel combination of the output load and output capacitor for a step increase in load current equal to $\Delta I_{load}$, and the absolute value of the minimum available slope of the current injected toward the parallel combination of the output load and output capacitor for a step decrease in load current equal to $\Delta I_{load}$ This is the done as described above in connection with equation 1.

4. Determine which of the two absolute values is smaller. The smaller absolute value is identified as m.

5. Determine a first capacitance $C_0$ in accordance with the following: $C_0=[\Delta I_{load}^2/2m+mT_c^2/2]/\Delta V_{out}$.

6. Determine a resistance $R_{e0}$ in accordance with the following: $R_{e0}=T_c/C_0$.

7. Determine a critical capacitance value $C_{crit}$ in accordance with the following: $C_{crit}=\Delta I_{load}/mR_{e0}$.

8. If $C_0<C_{crit}$, use an output capacitor having a capacitance $C_1$ about equal to $C_0$ and an equivalent series resistance $R_{e1}$ about equal to $R_{e0}$.

If $C_0 \geqq C_{crit}$, use an output capacitor having an equivalent series resistance $R_{e2}$ about equal to $\Delta V_{out}/\Delta I_{load}$ and a capacitance $C_2$ about equal to $T_c/R_{e0}$.

9. Determine a resistance $R_o$ in accordance with the following:

If $C_0<C_{crit}$: $R_o=\Delta I_{load}/2mC_1+[mC_1(R_{e1})]/2\Delta I_{load}$.

If $C_0 \geqq C_{crit}$: $R_o=R_{e2}$.

10. Arrange the voltage regulator such that its output impedance, defined before its connection to the output capacitor used, is about equal to the series combination of resistance $R_o$ and an inductance $L_o$, with $L_o$ given by the following:

If $C_0<C_{crit}$: $L_o=C_1*R_{e1}*R_o$.

If $C_0 \geqq C_{crit}$: $L_o=C_2*R_{e2}*R_o$.

This step is accomplished by making the transfer function for the regulator's feedback circuit correspond with equation 4, in accordance with the methods described above.

Note that time constant $T_c$ (or its constituent factors C and $R_e$) is not a precisely defined quantity for a particular capacitor type. A number of factors, including manufacturing tolerances, case size, temperature and voltage rating, can all affect $T_c$. Thus, in a practical design, the parameter $T_c$ used in the calculations should be considered as an approximate value, and a number of iterations through the design procedure may be necessary.

The inventive method can also be presented as a procedure specifically directed to the design of a buck-type switching voltage regulator employing current-mode control, which minimizes the size of the regulator's output capacitor while ensuring that its output voltage $V_{out}$ is maintained within a specified voltage deviation specification $\Delta V_{out}$ for a step change in load current $\Delta I_{load}$. This type of regulator has a pair of switches connected in series between an input voltage $V_{in}$ and ground, with the junction between the switches connected to an output inductor. The switches are driven to alternately connect the inductor to $V_{in}$ and to ground. Note that the design procedure below is applicable only for the case when $C>C_{crit}$, and as such it achieves the optimum load transient response shown in FIG. 6*a*; a buck-type regulator employing current-mode control could also use an output capacitor having a capacitance less than $C_{crit}$—and thereby achieve the optimum response shown in FIG. 7*a*—by following the design procedure described above. The design procedure applicable when $C>C_{crit}$ can be practiced by following the steps below:

1. Calculate a maximum equivalent series resistance $R_{e(max)}$ for the regulator's output capacitor in accordance with the following: $R_{e(max)}=\Delta V_{out}/\Delta I_{load}$.

2. Determine a minimum inductance $L_{min}$ for the regulator's output inductor in accordance with the following: $L_{min}=(V_{out}T_{off}R_{e(max)})/V_{ripple,p\text{-}p}$, where $T_{off}$ is the off time of the switch which connects the output inductor to $V_{in}$, and $V_{ripple,p\text{-}p}$ is the maximum allowable peak-to-peak output ripple voltage.

3. Use an output inductor with an inductance L1 which is equal to or greater than $L_{min}$.

4. Determine a minimum capacitance $C_{min}$ for the output capacitor in accordance with the following:

if $V_{out}<(V_{in}-V_{out})$: $C_{min}=\Delta I_{load}/[R_{e(max)}(V_{out}/L1)]$;

if $V_{out}>V_{in}-V_{out}$: $C_{min}=\Delta I_{load}/[R_{e(max)}((V_{in}-V_{out})/L1)]$.

5. Use an output capacitor having a capacitance C about equal to $C_{min}$ and an equivalent series resistance $R_e$ about equal to $R_{e(max)}$.

6. Arrange the output impedance of the regulator to be about equal to $R_e$. This step is accomplished by making the transfer function for the regulator's feedback circuit correspond with equation 4, in accordance with the methods described above.

While particular embodiments of the invention have been shown and described, numerous variations and alternate embodiments will occur to those skilled in the art. For example, a trivial alternate embodiment of a buck-type switching regulator has the second switch replaced with a rectifier diode. Accordingly, it is intended that the invention be limited only in terms of the appended claims.

We claim:

1. A method of enabling a voltage regulator to employ the smallest possible output capacitor that allows the regulator's output voltage to be maintained within specified boundaries for bidirectional step changes in load current of a specified maximum magnitude, comprising the step of:

compensating a voltage regulator which employs an output capacitor and is required to maintain a regulated output voltage within specified boundaries for bidirectional step changes in load current of a specified maximum magnitude such that, after the occurrence of a step change in load current of said specified maximum magnitude, its output voltage response is flat after its output voltage reaches one of said specified boundaries, the output capacitor required to provide said compensation being the smallest possible output capacitor that allows the regulator's output voltage to be maintained within said specified boundaries.

2. A method of minimizing the size of a voltage regulator's output capacitor which enables the regulator's output voltage to be maintained within a specified voltage deviation specification $\Delta V_{out}$ for a bidirectional step change in load current $\Delta I_{load}$, comprising the steps of:

selecting a type of capacitor to be used as the output capacitor for a voltage regulator connected to provide a regulated output voltage to an output load at an output node, said output capacitor to be connected in parallel across said load, said regulator required to maintain a regulated output voltage within a specified voltage deviation specification $\Delta V_{out}$ for a bidirectional step change in load current $\Delta I_{load}$, determining the characteristic time constant $T_c$ for the selected capacitor type, determining the absolute value of the maximum available slope of the current injected by the voltage regulator toward the parallel combination of the output load and output capacitor for a step increase in load current equal to $\Delta I_{load}$ and the absolute value of the minimum available slope of the current injected toward the parallel combination of the output load and output capacitor for a step decrease in load current equal to $\Delta I_{load}$, determining which of said absolute values is smaller, the smaller of said absolute values being a value m, determining a first capacitance $C_0$ in accordance with the following: $C_0=[\Delta I_{load}^2/2m+mT_c^2/2]/\Delta V_{out}$ determining a resistance $R_{e0}$ in accordance with the following: $R_{e0}=T_c/C_0$ determining a critical capacitance $C_{crit}$ in accordance with the following: $C_{crit}=\Delta I_{load}/mR_{e0}$, selecting an output capacitor for connection across said load having a capacitance $C_1$ about equal to $C_0$ and an equivalent series resistance $R_{e1}$ about equal to $R_{e0}$ if $C_0$ is less than $C_{crit}$, selecting an output capacitor for connection across said load having a capacitance $C_2$ about equal to $T_c/R_{e0}$ and an equivalent series resistance $R_{e2}$ about equal to $\Delta V_{out}/\Delta I_{load}$ if $C_0$ is equal to or greater than $C_{crit}$, determining a resistance $R_o$ in accordance with the following if $C_0$ is less than $C_{crit}$:

$$R_o=\Delta I_{load}/2mC_1+[mC_1R_{e1}]/2\Delta I_{load}$$

determining a resistance $R_o$ in accordance with the following if $C_0$ is equal to or greater than $C_{crit}$: $R_o=R_{e2}$, and arranging the voltage regulator such that its output impedance, defined before its connection to the selected output capacitor, is about equal to the series combination of resistance $R_o$ and an inductance $L_o$, with $L_o$ given by the following if $C_0$ is less than $C_{crit}$:

$$L_o=C_1*R_{e1}*R_o,$$

or given by the following if $C_0$ is equal to or greater than $C_{crit}$: $L_o=C_2*R_{e2}*R_o$.

3. The method of claim 2, wherein said voltage regulator is a buck-type switching voltage regulator having an output inductor with an inductance L and which receives an input voltage $V_{in}$ and produces an output voltage $V_{out}$, said value of m given by $m=V_{out}/L$ if $V_{out}$ is less than $V_{in}-V_{out}$ and by $(V_{in}-V_{out}/L$ if $V_{out}$ is greater than $V_{in}-V_{out}$.

4. The method of claim 2, wherein said voltage regulator includes a controllable power stage which provides the regulator's output voltage in response to a signal received at a control input and a voltage error amplifier connected between said output node and said control input, said power stage having a transconductance g, said step of arranging said output impedance to be about equal to the series combination of resistance $R_o$ and inductance $L_o$ accomplished by making the gain K(s) of said voltage error amplifier equal to the following:

$$K(s)=(-1/gR_o)(1/(1+sR_eC))$$

in which C and $R_e$ are the capacitance and equivalent series resistance of the output capacitor employed.

5. The method of claim 2, wherein said voltage regulator includes an impedance Z1 connected between said output node and a first node, an impedance Z2 connected between said first node and a reference voltage, a current sensor which has a transresistance $R_s$ and produces an output that varies with the output current delivered to said load, a summing circuit which produces an output voltage equal to the sum of the current sensor output voltage and the regulator's output voltage, and a controllable power stage which provides the regulator's output voltage in accordance with the voltage difference between the voltage at said first node and said summing circuit output voltage, said step of arranging said output impedance to be about equal to the series combination of resistance $R_o$ and inductance $L_o$ accomplished by making the ratio of impedances Z1 and Z2 equal to the following:

$$Z2/Z1=[R_o(1+sR_eC)-R_s]/R_s$$

in which C and $R_e$ are the capacitance and equivalent series resistance of the output capacitor employed.

6. A method of minimizing the size of a voltage regulator's output capacitor which enables the regulator's output voltage to be maintained within a specified voltage deviation specification $\Delta V_{out}$ for a bidirectional step change in load current $\Delta I_{load}$, comprising the steps of:

calculating a maximum equivalent series resistance $R_{e(max)}$ for an output capacitor to be employed by a voltage regulator which provides an output voltage to a load at an output node, said output capacitor to be connected in parallel across said load, said regulator required to maintain said output voltage within a specified voltage deviation specification $\Delta V_{out}$ for a bidirectional step change in load current $\Delta I_{load}$, $R_{e(max)}$ calculated in accordance with the following: $R_{e(max)}=\Delta V_{out}/\Delta I_{load}$, determining the absolute value of the maximum available slope of the current injected by the voltage regulator toward the parallel combination of the output load and output capacitor for a step increase in load current equal to $\Delta I_{load}$ and the absolute value of the minimum available slope of the current injected toward the parallel combination of the output load and output capacitor for a step decrease in load current equal to $\Delta I_{load}$, determining which of said absolute values is smaller, the smaller of said absolute values being a value m, determining a critical capacitance $C_{crit}$ in accordance with the following: $C_{crit}=\Delta I_{load}/mR_{e(max)}$, selecting an output capacitor for connection across said load having an equivalent series resistance $R_e$ that is slightly less than or equal to $R_{e(max)}$ and a capacitance that is greater than or equal to $C_{crit}$, and arranging the output impedance of said voltage regulator to be about equal to $R_e$.

7. The method of claim 6, wherein said voltage regulator includes a controllable power stage which provides the regulator's output voltage in response to a signal received at a control input and a voltage error amplifier connected between said output node and said control input, said power stage characterized by a transconductance g, said step of arranging said output impedance to be about equal to $R_e$ accomplished by making the gain K(s) of said voltage error amplifier equal to the following:

$$K(s)=(-1/gR_e)(1/(1+sR_eC))$$

in which C and $R_e$ are the capacitance and equivalent series resistance of the output capacitor employed.

8. A method of minimizing the size of a buck-type switching voltage regulator's output capacitor which enables the regulator's output voltage $V_{out}$ to be maintained within a specified voltage deviation specification $\Delta V_{out}$ for a bidirectional step change in load current $\Delta I_{load}$, comprising the steps of:

calculating a maximum equivalent series resistance $R_{e(max)}$ for an output capacitor to be employed by a current-mode controlled switching voltage regulator which receives an input voltage $V_{in}$ and provides an output voltage $V_{out}$ to a load connected to an output node via an output inductor, said inductor alternately connected to $V_{in}$ and ground via first and second switches, respectively, said output capacitor to be connected in parallel across said load, said regulator required to maintain $V_{out}$ within a specified voltage deviation specification $\Delta V_{out}$ for a bidirectional step change in load current $\Delta I_{load}$, $R_{e(max)}$ calculated in accordance with the following: $R_{e(max)}=\Delta V_{out}/\Delta I_{load}$, determining a minimum inductance $L_{min}$ for said output inductor in accordance with the following:

$$L_{min}=V_{out}T_{off}R_{e(max)}/V_{ripple,p\text{-}p}$$

where $T_{off}$ is the off time of said first switch and $V_{ripple,p\text{-}p}$ is the maximum allowed peak-to-peak output ripple voltage, selecting an output inductor for use in said regulator having an inductance L1 which is equal to or greater than $L_{min}$, determining a minimum capacitance $C_{min}$ for said output capacitor in accordance with the following:

$$C_{min}=\Delta I_{load}[R_{e(max)}(V_{out}/L1)] \text{ if } V_{out}<(V_{in}-V_{out})$$

and in accordance with the following:

$$C_{min}=\Delta I_{load}[R_{e(max)}((V_{in}-V_{out})/L1)] \text{ if } V_{out}>V_{in}-V_{out},$$

selecting an output capacitor for connection across said load having a capacitance C about equal to $C_{min}$ and an equivalent series resistance $R_e$ about equal to $R_{e(max)}$, and arranging the output impedance of said regulator to be about equal to $R_e$.

9. The method of claim 8, wherein said voltage regulator includes a controllable power stage which provides the regulator's output voltage in response to a signal received at a control input and a voltage error amplifier connected between said output node and said control input, said power stage characterized by a transconductance g, said step of arranging said output impedance to be about equal to $R_e$ accomplished by making the gain K(s) of said amplifier equal to the following:

$$K(s)=(-1/gR_e)(1/(1+sR_eC))$$

in which C and $R_e$ are the capacitance and equivalent series resistance of the output capacitor employed.

10. A voltage regulator which maintains its output voltage within a specified voltage deviation specification $\Delta V_{out}$ for a bidirectional step change in load current $\Delta I_{load}$, comprising:

a controllable power stage characterized by a transconductance g and connected to produce an output voltage $V_{out}$ at an output node in accordance with a signal received at a control input, said output node connected to a load, an output capacitor connected to said output node and in parallel across said load, said output capacitor having an equivalent series resistance $R_e$, and a voltage error amplifier connected between said output node and said control input, said controllable power stage, said output capacitor and said amplifier forming a voltage regulator required to maintain the voltage at said output node within a specified voltage deviation specification $\Delta V_{out}$ for a step change in load current $\Delta I_{load}$, said output capacitor having a capacitance that is equal to or greater than a critical capacitance $C_{crit}$, in which $C_{crit}$ is given by the following: $C_{crit}=\Delta I_{load}/mR_e$, where m is equal to the smaller of 1) the absolute value of the maximum available slope of the current injected by the voltage regulator toward the parallel combination of the output load and output capacitor for a step increase in load current equal to $\Delta I_{load}$, or 2) the absolute value of the minimum available slope of the current injected by the voltage regulator toward the parallel combination of the output load and output capacitor for a step decrease in load current equal to $\Delta I_{load}$, said voltage regulator arranged to have an output impedance which is about equal to $R_e$.

11. The voltage regulator of claim 10, wherein the gain K(s) of said voltage error amplifier is given by the following:

$$K(s)=(-1/gR_e)(1/(1+sR_eC))$$

where g is equal to the transconductance of said controllable power stage, and $R_e$ and C are equal to the equivalent series resistance and capacitance, respectively, of said output capacitor.

12. The voltage regulator of claim 10, wherein said controllable power stage comprises a power circuit connected to produce said regulator's output voltage in accordance with a signal received at a control input, a current sensor connected in series between said power circuit and said output node which produces an output that varies with said power circuit's output current, and a current controller connected to receive the outputs of said voltage error amplifier and said current sensor as inputs and producing an output connected to said power circuit's control input for controlling said power circuit.

13. The voltage regulator of claim 12, wherein said current controller is an amplifier and said power circuit is a series pass transistor, said regulator being a linear voltage regulator.

14. The voltage regulator of claim 10, wherein said regulator is a switching voltage regulator.

15. The voltage regulator of claim 10, wherein said output capacitor has a capacitance about equal to $C_{crit}$ and an equivalent series resistance $R_e$ about equal to $\Delta V_{out}/\Delta I_{load}$, said capacitor being the smallest possible output capacitor which enables the regulator to maintain its output voltage within $\Delta V_{out}$ for a step change in load current $\Delta I_{load}$.

16. A voltage regulator which maintains a regulated output voltage within a specified voltage deviation specification $\Delta V_{out}$ for a bidirectional step change in load current $\Delta I_{load}$, comprising:

a controllable power stage characterized by a transconductance g and connected to produce an output voltage $V_{out}$ at an output node in accordance with a signal received at a control input, said output node connected to an output load, an output capacitor connected to said output node and in parallel across said output load, and a voltage error amplifier connected between said output node and said control input, said power stage, said output capacitor and said amplifier forming a voltage regulator required to maintain a voltage at said output node within a specified voltage deviation specification $\Delta V_{out}$ for a step change in load current $\Delta I_{load}$, said amplifier arranged to have a gain K(s) given by the following:

$$K(s)=(-1/gR_o)(1/(1+sR_eC))$$

where g is equal to the transconductance of said controllable power stage, $R_e$ and C are equal to the equivalent series resistance and capacitance, respectively, of said output capacitor, and where $R_o$ is equal to: $R_e$, if C is greater than or equal to $\Delta I_{load}/mR_e$, or to:

$$\Delta I_{load}/2mC+[mC(R_e)]/2\Delta I_{load}, \text{ if C is less than } \Delta I_{load}/mR_e,$$

where m is equal to the smaller of 1) the absolute value of the maximum available slope of the current injected by the voltage regulator toward the parallel combination of the output load and output capacitor for a step increase in load current equal to $\Delta I_{load}$, or 2) the absolute value of the minimum available slope of the current injected by the voltage regulator toward the parallel combination of the output load and output capacitor for a step decrease in load current equal to $\Delta I_{load}$.

17. A voltage regulator which maintains a regulated output voltage within a specified voltage deviation specification $\Delta V_{out}$ for a step change in load current $\Delta I_{load}$, said regulator comprising:

a controllable power stage which provides an output voltage to a load at an output node in accordance with the voltage difference between a first control input and a second control input, an output capacitor connected to said output node and in parallel across said load, an impedance Z1 connected between said output node and a first node, an impedance Z2 connected between said first node and a reference voltage, a current sensor which has a transresistance $R_s$ and produces an output voltage that varies with the output current delivered to said load, a summing circuit which produces an output voltage equal to the sum of the sensor output voltage and the voltage at said output node, said current sensor output voltage and said summing circuit output voltage connected to said first and second control inputs, respectively, said controllable power stage, said output capacitor, said impedances, said current sensor and said summing circuit forming a voltage regulator required to maintain the voltage at said output node within a specified voltage deviation specification $\Delta V_{out}$ for a step change in load current $\Delta I_{load}$, said regulator arranged such that the ratio of impedances Z1 and Z2 is equal to the following:

$$Z1/Z2=[R_o(1+sR_eC)-R_s]/R_s$$

where $R_e$ and C are equal to the equivalent series resistance and capacitance, respectively, of said output capacitor, and where $R_o$ is equal to: $R_e$, if C is equal to or greater than $\Delta I_{load}/mR_e$, or to:

$$\Delta I_{load}/2mC+[mC(R_e)]/2\Delta I_{load}, \text{ if C is less than } \Delta I_{load}/mR_e,$$

where m is equal to the smaller of 1) the absolute value of the maximum available slope of the current injected by the voltage regulator toward the parallel combination of the output load and output capacitor for a step increase in load current equal to $\Delta I_{load}$, or 2) the absolute value of the minimum available slope of the current injected by the voltage regulator toward the parallel combination of the output load and output capacitor for a step decrease in load current equal to $\Delta I_{load}$.

18. The voltage regulator of claim 17, wherein said controllable power stage comprises:

a power circuit connected to produce said regulator's output voltage in response to a signal received at a control input, and a fast voltage controller producing an output signal to said control input of said power circuit in accordance with the voltage difference between the voltage at said first node and the output voltage of said summing circuit.

19. The voltage regulator of claim 18, wherein said power circuit comprises a pair of series-connected switches and an output inductor, said output inductor connected between the junction of said switches and said output node, and said fast voltage controller comprises a hysteretic comparator and a driving circuit, said driving circuit connected to control the states of said switches in accordance with a signal received at a control input, said comparator connected to receive the voltage at said first node and the output voltage of said summing circuit as inputs and producing an output connected to said driving circuit's control input.

20. The voltage regulator of claim 19, wherein said impedance Z1 is implemented with a resistor R1 and a capacitor C1 connected in parallel, and impedance Z2 is implemented with a resistor R2, said resistors R1 and R2 and capacitor C1 arranged such that the output impedance of said voltage regulator is equal to $R_e$, whereby:

$$R2/R1=(R_o-R_s)/R_s, \text{ and}$$

$$C1*R1=C[(R_oR_e)/R_s].$$

21. The voltage regulator of claim 17, wherein said current sensor and summing circuit comprise a resistor having a resistance $R_s$ connected between said controllable output stage at a second node and said output node, the voltage at said second node being said summing circuit output voltage.

* * * * *